US012285645B2

(12) United States Patent
Wiese, II

(10) Patent No.: US 12,285,645 B2
(45) Date of Patent: Apr. 29, 2025

(54) MULTI-PURPOSE EXERCISE EQUIPMENT

(71) Applicant: Robert Elton Wiese, II, Greenacres, WA (US)

(72) Inventor: Robert Elton Wiese, II, Greenacres, WA (US)

( * ) Notice: Subject to any disclaimer, the term of this patent is extended or adjusted under 35 U.S.C. 154(b) by 159 days.

(21) Appl. No.: 17/887,173

(22) Filed: Aug. 12, 2022

(65) Prior Publication Data

US 2023/0049746 A1 Feb. 16, 2023

Related U.S. Application Data

(60) Provisional application No. 63/232,456, filed on Aug. 12, 2021.

(51) Int. Cl.
*A63B 21/06* (2006.01)
*A63B 21/00* (2006.01)

(52) U.S. Cl.
CPC ..... *A63B 21/0604* (2013.01); *A63B 21/4033* (2015.10)

(58) Field of Classification Search
CPC ..... A63B 21/4033; A63B 21/0604; A63B 21/4035; A63B 9/00; A63B 21/072; A63B 71/0036; A63B 21/0004; A63B 21/00058; A63B 21/06; A63B 21/0632; A63B 21/0724; A63B 21/078; A63B 21/08; A63B 21/4019; A63B 21/4023; A63B 21/4027; A63B 21/1645
See application file for complete search history.

(56) References Cited

U.S. PATENT DOCUMENTS

| | | | | |
|---|---|---|---|---|
| 9,770,618 | B2 * | 9/2017 | Wall | A63B 21/0557 |
| 10,188,892 | B1 * | 1/2019 | Gvoich | A63B 21/0605 |
| 10,226,662 | B1 * | 3/2019 | Mink | A63B 17/00 |
| 2017/0065845 | A1 * | 3/2017 | Pinkus | A63B 21/4035 |
| 2019/0247701 | A1 * | 8/2019 | Sergakis | A63B 21/078 |
| 2020/0246657 | A1 * | 8/2020 | Wittenbrink | A63B 21/4033 |
| 2021/0138289 | A1 * | 5/2021 | Jones | A63B 5/16 |

OTHER PUBLICATIONS

Aug. 4, 2020 Valor Fitness sales page for Wall Mounted 4 Peg Olympic Plate Storage Holder (https://valorfitness.com/collections/plate-storage/products/bh-26-4-peg-wall-mounted-weight-plate-storage-holder) (Year: 2020).*
Titan Fitness sales page for Wall Mounted 6 Barbell Rack V2 (https://titan.fitness/products/wall-mounted-6-barbell-rack-v2) (Year: 2020).*
Google Chrome search history for case completed on Oct. 21, 2024 (Year: 2024).*
Titan Fitness sales page for Wall Mounted 6 Barbell Rack V2 (Year: 2020).*

* cited by examiner

*Primary Examiner* — Megan Anderson
*Assistant Examiner* — Jonathan A Dicuia
(74) *Attorney, Agent, or Firm* — Lee & Hayes, P.C.

(57) ABSTRACT

An apparatus includes a cuboid exercise weight and one or more wall mounts. The exercise weight may be utilized in a variety of workouts due to the various locations and angles of the handles. Further, the exercise weight may be attached to the one or more wall mounts allowing for the user to perform exercises from an elevated position.

20 Claims, 10 Drawing Sheets

MULTI-PURPOSE EXERCISE EQUIPMENT

PRIORITY

This application claims benefit of priority to U.S. Provisional Application Ser. No. 63/232,456, filed Aug. 12, 2021 and entitled "Multi-Purpose Exercise Equipment," the entire contents of which are incorporated herein by reference.

BACKGROUND

As at-home exercising is growing increasingly more common, challenges associated with finding suitable exercise equipment arise. While these challenges are numerous, some include finding compact, multipurpose, and functional exercise equipment. For instance, equipment may often require extensive space, while only accommodating a select few exercises.

Finding compact, multipurpose, and functional exercise equipment presents many difficulties. Particularly, since each house, apartment, or similarly restricted spaces have predefined height, length, and width requirements, users have a restricted amount of exercise space within which to put exercise equipment.

Current at-home exercise equipment may be inadequate in that the equipment requires an extensive amount of space, the equipment does not include sufficient weight for a user to obtain an effective workout, and the equipment may often be too complicated for the average at-home user to master.

BRIEF DESCRIPTION OF THE DRAWINGS

The Detailed Description is set forth with reference to the accompanying figures. In the figures, the left-most digit(s) of a reference number identifies the figure in which the reference number first appears. The use of the same reference numbers in different figures indicates similar or identical items. Furthermore, the drawings may be considered as providing an approximate depiction of the relative sizes of the individual components within individual figures. However, the drawings are not to scale, and the relative sizes of the individual components, both within individual figures and between the different figures, may vary from what is depicted. In particular, some of the figures may depict components as a certain size or shape, while other figures may depict the same components on a larger scale or differently shaped for the sake of clarity.

DETAILED DESCRIPTION

Overview

Figure 1:
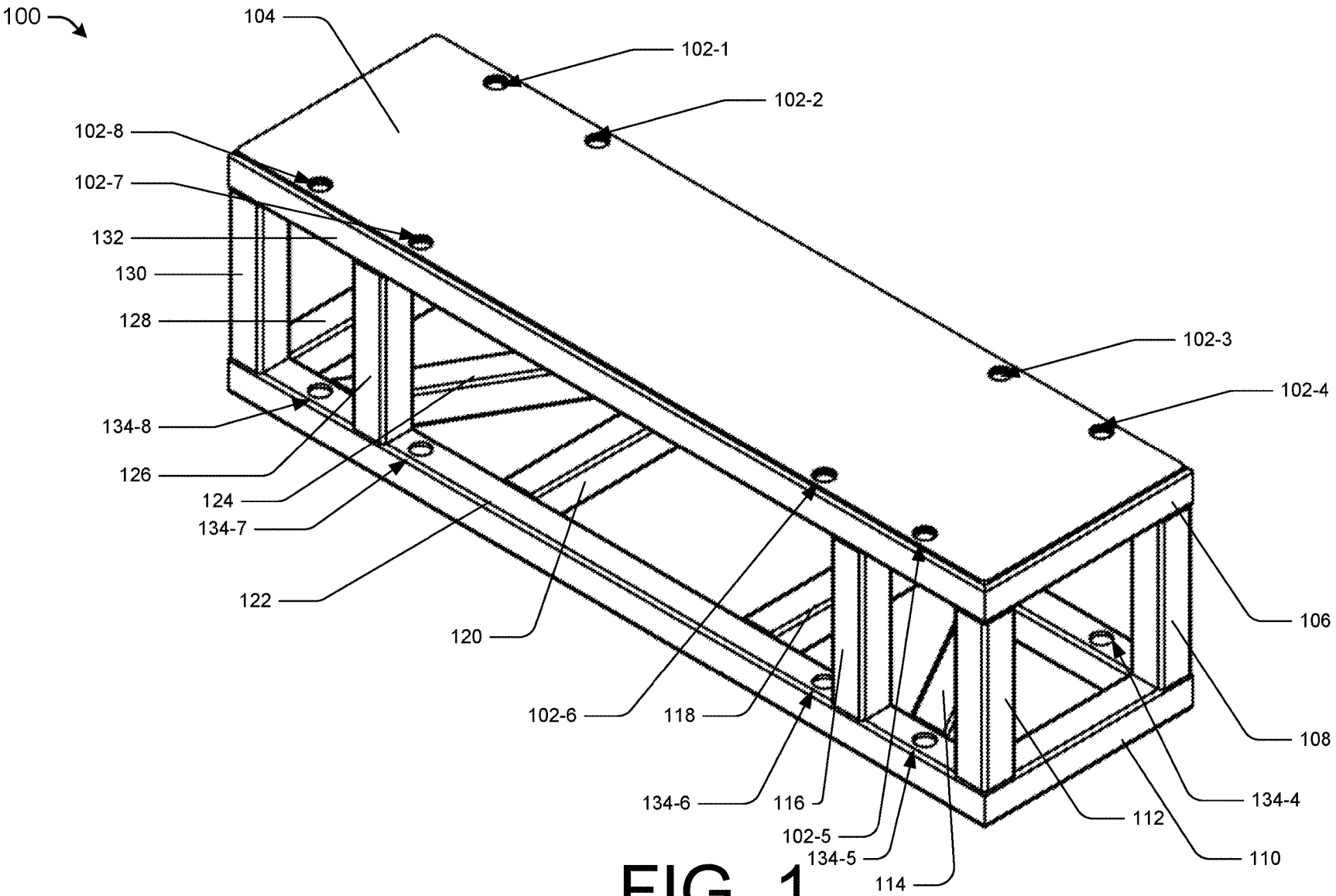
FIG. 1 illustrates a perspective view of an example exercise weight that forms at least a portion of an example exercise system described herein. As illustrated and discussed below, the exercise system may comprise the illustrated exercise weight and a corresponding wall mount to which the exercise weight may removably couple.

An example exercise system described herein may comprise, in some instances, a cuboid-shaped exercise weight and a wall mount to which the exercise weight removably couples. In some instances, the exercise system enables a more compact and simpler workout as compared to home gyms and other forms of traditional exercise equipment. Given the compact nature (i.e., small footprint) of the exercise weight and mount, users living in homes, apartments, or the like may utilize the exercise system without needing to dedicate an entire room or even a substantial portion of a room to the exercise system. In addition, the multipurpose nature of the cuboid exercise weight allows users to adequately workout each body part while using a single weight. Further, the nature of the weight allows for users of all skill and exercising levels to utilize such a weight with minimal moving parts and maintenance.

The compact nature of the exercise weight and wall mount allow a user to utilize the weight and/or mount on virtually any wall in the user's place of residence. As the weight is shaped as a hollow cuboid in some instances, minimal space is required. Further, one or more mount(s) may be placed on any wall to engage with the cuboid. The one or more mount(s) enables the user to utilize the weight for numerous exercises, while still remaining compact on the wall.

The multipurpose nature of the exercise weight and/or mount allows the user to adequately workout each body part while using a single weight. For example, the user may attach the weight to the wall mount, utilizing any of the various handles to perform exercises such as: pull-ups, chin ups, leg raises, muscle ups, or the like. In another example, the user may disengage the weight from the mount and utilize any of the various handles to perform bicep curls, triceps extension, shoulder press, squats, or the like. Further, the user may place the weight on the ground and perform step-ups, extended one leg squats, or the like. Alternatively, the user may utilize the mount which contains one or more predefined holes under or otherwise proximate to each extended prong, to which attachments may be applied. Utilizing the mount attachments, users may attach ropes, elastic bands, bars, or the like to perform bicep curls, triceps extensions, chest fly, back row, rope climb, or other like workouts. Further, it is important to note that any of the aforementioned exercises may be executed while using the numerous different handle options which alter the engagement of the targeted muscle group. Further, in some instances the exercise system described herein may be operable with an exercise program, such as a subscription-based application that includes daily or otherwise periodic workouts, each of which instruct the user to perform an array of exercises using the specific configuration of the system described herein. The system described herein may also be accompanied by one or more additional pieces of exercise equipment, such as a floor mat, a wall protector, bands to couple to the mounts (as described below), and/or the like.

In addition, the exercise weight provides users the option of increasing the weight of the predefined cuboid exercise weight by attaching hooks, clips, holding slots, or the like to accommodate an addition of one or more weight(s) (e.g., increase the weight of cuboid exercise weight from 45 lbs. to 55 lbs.). In some instances, the exercise system may include one or more magnetic weights that removably and magnetically couple to the cuboid-shaped weight in order to increase (or decrease) the overall weight utilized by the user. These magnetic weights may take any shape and may couple to the cuboid weight in any manner. For instance, the magnetic weights may comprise hockey-puck-shaped magnets that attach to underside of the cuboid weight (e.g., in the hollow portion of the weight), thin-rectangular-shaped magnets that attach to an outer face of the cuboid weight, or the like.

The straightforward yet flexible nature of the cuboid exercise weight and wall mount allows users of all skill levels to effectively utilize such a weight and mount. The exercise weight may be formed of a single part, minimizing the accessories and maintenance required for effective use of the weight. In addition, the various handles and features on different faces of the cuboid weight may enable an array of different exercises and/or enable users of the equipment to target any number of muscle groups. Further, attaching the exercise weight to the mount enables additional exercises and merely requires the user to align the two or more attachment prongs of the mount with the two or more holes in the exercise weight. Once the prongs of the mount and the holes of the exercise weight are aligned, the exercise weight slides down, engaging with the mount, securing the exercise weight to the wall mount. Of course, while this example describes the cuboid-shaped weight as attaching to the wall mount via four holes, it is to be appreciated that the weight may attach to the wall mount in any other manner, such as via any other number of holes and prongs, magnetically, a force fit, or the like.

The exercise system described herein may be made from any type of metal, plastic, composite, and/or any other type of material or combination thereof. Further, while the examples described herein discuss a cuboid-shaped weight, in other instances the weight may take any other shape such as cylindrical, cube-shaped, or the like. While the example exercise system is described below with reference to FIGS. 1-10, it is to be appreciated that these are merely illustrative and that other embodiments may include similar and/or different features.

Illustrative Embodiments of an Exercise Weight and Mount

FIG. 1 illustrates a perspective view of example cuboid-shaped exercise weight 100 of an exercise system described herein. As illustrated, the top side of the exercise weight includes a plate 104 attached thereto. The plate 104 may comprise any sort of platform upon which a user may stand on, step onto, jump onto, and the like. While illustrated as a solid plate in this example, in other instances the plate 104 may comprise a grill-like platform or the like. In one example, the plate 104 comprises diamond plate that includes protrusions extending from the top side of the plate 104.

In one example, the user may place the exercise weight 100 on the ground with the plate 104 facing up. In this example, the plate 104 may include a diamond plate that includes protrusions extending from the top side of the plate 104. The user may utilize the exercise weight by performing exercises such as step-ups, box jumps, or the like. The protrusions extending from the plate 104 provide traction and grip as the user is stepping onto, standing on, or jumping onto the plate 104 from different angles. The traction and grip allow the user to perform the aforementioned exercises without the user's shoes slipping off the plate 104. Further, the protrusions extend from the plate 104 far enough that even when sweat from the user rests on the plate 104, the user is still able to maintain grip with the protrusions. In one example, the protrusions may include diamond plating texturing as described above.

In another example, the exercise weight 100 may be placed on the floor with the plate 104 against the ground. In this example, users may grip any combination of handles to perform pushups, burpees, dips, or any other like workout.

Further illustrated in FIG. 1 are handles 106, 108, 110, 112, 114, 116, 118, 120, 122, 124, 126, 128, 130, and 132. Each of the handles are configured to provide different hand gripping options, allowing the user to adjust the strain of a particular muscle group. Further, some handles may be disposed at an angle, providing the user alternative grips that may be suitable for different exercises. In addition, FIG. 1 illustrates that each of the handles may be designed with four rounded corners. Of course, while this example illustrates handles squarely shaped, it is to be appreciated that the handles could be designed in any other shape (e.g., rounded, rectangular, triangular, etc.).

The dimensions of the cuboid exercise weight may range from 1.5-6.0 feet in length and 0.5-3.0 feet in height, depending on the shape and predetermined weight. Each of the handles may be 0.5-2.0 inches in width and 4.0-72.0 inches in length, depending on the shape (e.g., rectangle, square, etc.) and predetermined weight of the exercise weight 100. Of course, while this example illustrates various dimensions for the exercise weight and its handles, it is to be appreciated that the dimensions may vary depending on the shape and predefined weight of the exercise weight 100. In one example, an exercise weight may be a rectangular cuboid having an overall length 5.0 feet, a height of 1.0 foot, and circular handles. In this example, the exercise weight 100 is long enough that multiple users may engage in step ups, box jumps, or the like at the same time.

In one example, the user may use their hands to grip any combination of handles to perform a workout. In this example, a user may be standing while holding grips 126 and 116. The user may perform bicep curls, shoulder press, lounges, or the like. It is to be appreciated that the user may perform any type of workout and use any combination of handles on any of the exercise weight's 100 sides.

Further illustrated in FIG. 1 are voids 102-1, 102-2, 102-3, 102-4, 102-5, 102-6, 102-7, 102-8 (collectively referred to as void(s) 102) defined within the plate 104. Also illustrated are voids 134-4, 134-5, 134-6, 134-7, and 134-8 (collectively referred to as void(s) 134) defined within the handles. These voids 102 and 134 may be circular, rectangular, triangular, or the like for receiving prongs of the wall mount in order to couple the weight 100 to the wall mount, as introduced above and described in detail below. The distance between voids 102-1 and 102-4 may range from 1.5-5.0 feet in some instances. The distance between 102-1 and 102-2 may range from 1-12 inches in some instances.

In one example, one or more wall mount(s), illustrated and described below, may be placed on a wall at a defined location. When a user desires to attach the exercise weight 100 to the one or more wall mount(s), the user engages the prongs of the one or more wall mount(s) to the voids defined in the plate 104 and handles. In some situations, the placement of the wall mount may be restricted due to the contents behind the wall, contents of the wall, or the like, so the one or more wall mount(s) may be required to be spaced further, or closer, together. Depending on the distance from a first wall mount to a second wall mount, the exercise block 100 contains voids in differing locations to accommodate the varying distances. Thus, in one example, the user may place a first and second wall mount closer together and the prongs of the mounts may engage with voids 102-2 and 102-3 or 102-6 and 102-7 of the exercise weight 100, depending on the orientation of the exercise weight 100. Alternatively, if the mounts are further apart, the prongs of the mount may engage with the voids 102-1 and 102-4 or 102-5 and 102-8 depending on the orientation of the exercise weight 100. In one example, depending on the distance of a first mount to a second mount, the user may use any combination of the voids 102-(1-8). It is also to be appreciated that the exercise weight 100 may attach to any number of wall mounts.

In one example, the user may utilize the exercise system by attaching the exercise weight 100 to the one or more wall mount(s). While the exercise weight 100 is attached to the one or more wall mounts, the user may utilize any combination of handles to perform exercises such as: pull-ups, leg raises, muscle ups, or any other like workout.

Figure 2:
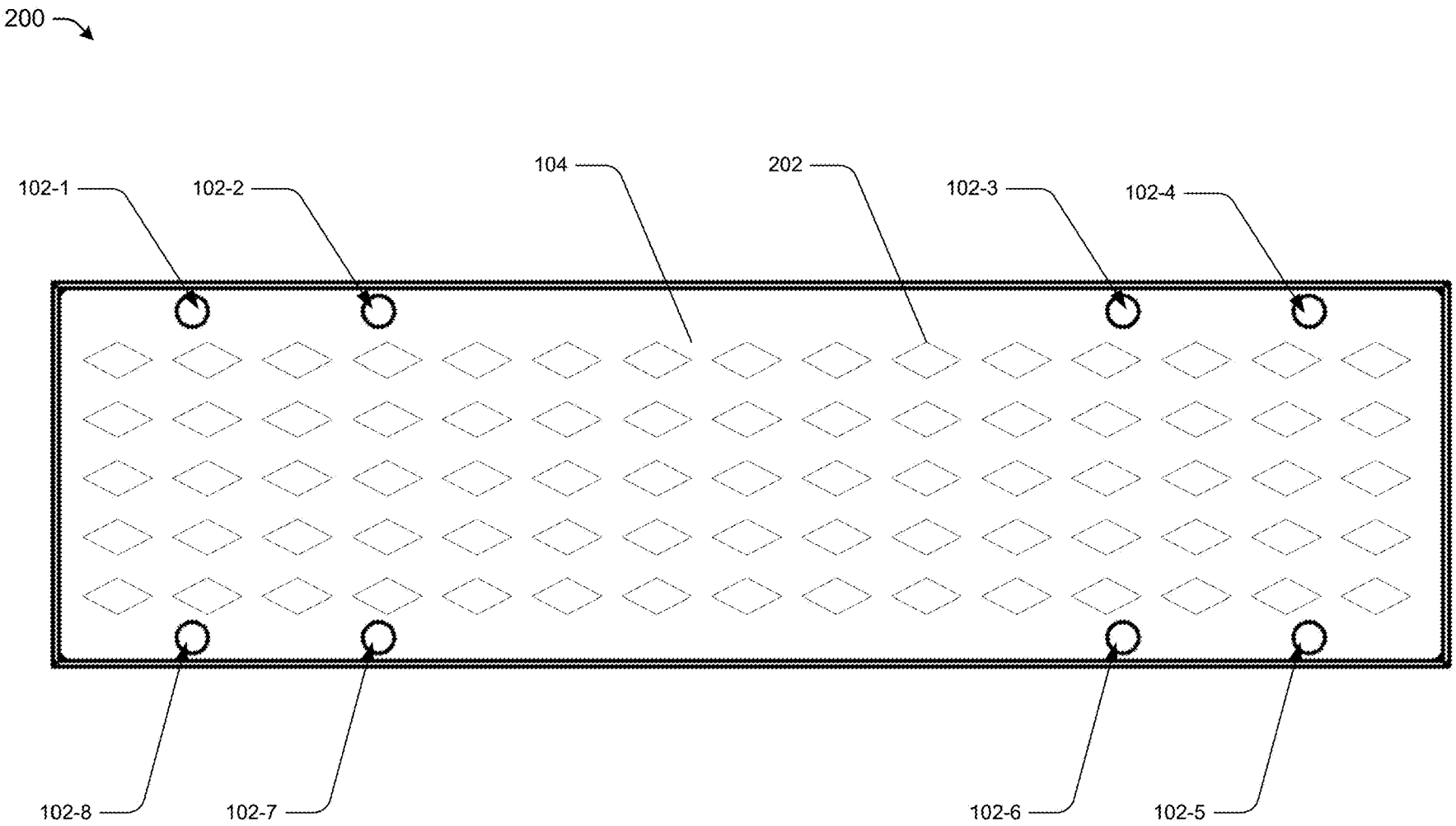
FIG. 2 illustrates a top view of the example exercise weight of FIG. 1.

FIG. 2 illustrates a top view of an example cuboid-shaped exercise weight 100 of an exercise system described herein. As illustrated, the top side of the exercise weight includes a plate 104 attached thereto. The plate 104 may comprise of any sort of platform upon which a user may stand on, step onto, jump onto, and the like. As shown in FIG. 2, the plate may include diamond plate protrusions 202 extending from the top side of the plate 104 which may be designed to increase the stability of the user when the user interacts with (or steps on) the plate 104. Of course, this is not intended to be limiting; in other examples, the plate 104 may be a solid plate. In this example the plate 104 is disposed on a single side of the exercise weight 100; however, it is to be appreciated that one or more plates 104 may be disposed on one or more sides of the exercise weight 100.

The dimensions of the plate 104 may range from 8-24 inches in width and 1.5-6 feet in length. In one example, the exercise weight may be 12 inches wide and 6 feet long. In some instances, the plate may be sized such that it is flush with each side of a frame of the exercise weight. With use of the plate, one or more users may perform exercises (e.g., step ups, box jumps, pull ups, etc.) at the same time. Further, while FIG. 2 illustrates a solid plate, it is to be appreciated that other implementations may utilize a plate this includes holes, slots, or the like.

As shown in FIG. 2, the plate 104 is disposed on a single side of the exercise weight 100. The plate 104 may weigh in a range of 1-10 pounds, depending on the shape, size, and desired predetermined weight of the exercise weight. In one example, a user may utilize handles 116 and 126 to perform various workouts. Alternatively, the user may utilize handles 120 and 118 to perform similar workouts. It is to be appreciated that the specific handles a user chooses will target a specific muscle group differently due to the weight of the plate 104 being located in a different position.

Also shown by FIG. 2, one or more voids 102-1, 102-2, 102-3, 102-4, 102-5, 102-6, 102-7, 102-8 (collectively referred to as void(s) 102) may be defined within the plate 104. These voids 102 may be circular, rectangular, triangular, or the like for receiving prongs of the wall mount in order to couple to weight 100 to the wall mount, as introduced above and described in detail below. In one example, a user may attach the exercise weight 100 to one or more wall mount(s) by placing the exercise weight 100 above the one or more wall mount(s), aligning the one or more all mount prong(s) with the corresponding void 102, and sliding the exercise weight 100 down, engaging the exercise weight 100 with the one or more wall mount prong(s).

Figure 3:
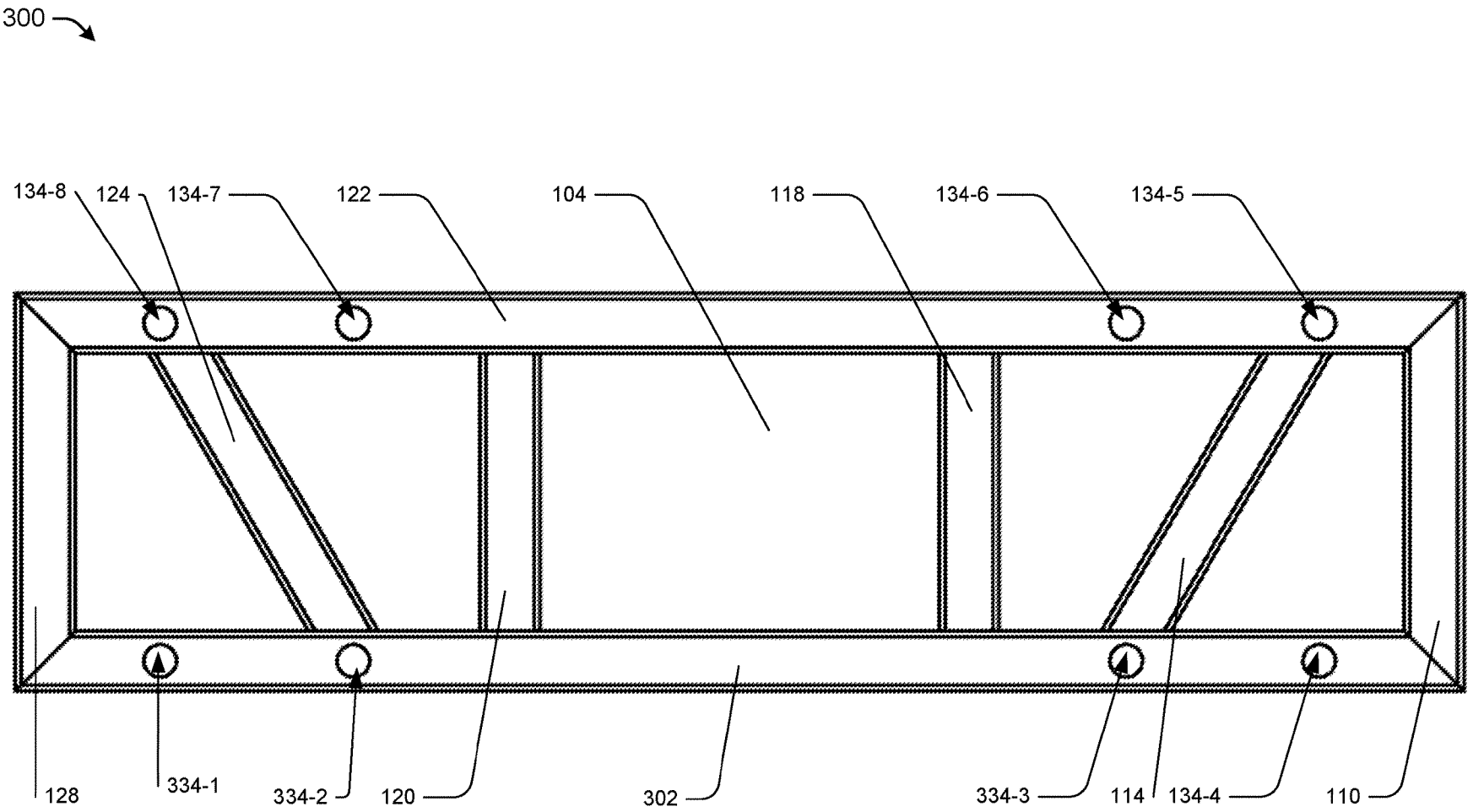
FIG. 3 illustrates a bottom view of the example exercise weight of FIG. 1.

FIG. 3 illustrates a bottom view of an example cuboid-shaped exercise weight 100 of an exercise system of as described herein. As illustrated, the bottom of the exercise weight 100 includes handles 110, 118, 120, and 128, which connect perpendicularly with handles 122 and 302. As will be appreciated, these handles 110, 128, 122, and 302 correspond to respective sides of a perimeter of a frame of the exercise weight 100, while handles 118 and 120 reside within the perimeter of the frame.

Further, handles 114 and 124 connect to handles 122 and 302 at an angle. IN some instances, this angle may comprise 45 degrees, although other angles may be used in other implementations. As will be appreciated having handles at varying angles may enable the working of different muscle groups when performing exercises such as pull-ups, chin-ups, push-ups, shoulder presses or the like.

FIG. 3 also illustrates voids 334-1, 334-2, 334-3, 134-4, 134-5, 134-6, 134-7, and 134-8 (collectively referred to as void(s) 134) defined in handles 122 and 302. These voids 102 may be circular, rectangular, triangular, or the like for receiving prongs of the wall mount in order to couple to weight 100 to the wall mount, as introduced above and described in detail below.

The dimensions from a handle to another handle varies depending on the shape, size, and predetermined weight of the exercise weight 100. As illustrated, however, the distance from handle 124 to 114 may range from 1.0-4.0 feet. Further, the distance from handle 120 to handle 118 may range from 0.5-2.8 feet. The distance from handle 124 to 120 may range from 2-12 inches. Of course, while this example describes various dimensions from one handle to another, it is appreciated that the distance from one handle to another may vary greatly, even beyond the ranges provided, depending on the size, shape, and predetermined weight of the exercise weight 100. Further, while the example weight 100 includes a number of example handles, it is to be appreciated that other embodiments of the weight may include more or less number of handles.

In one example, the user may place the exercise weight 100 on the ground, with the plate 104 in contact with the ground, to perform push-ups, burpees, dips, or the like utilizing any combination of handles. In another example, the user may stand and grip the exercise weight 100 and perform bicep curls, overhead triceps extensions, thrusters, squats, lounges, or the like while utilizing any combination of handles.

Additionally, the user may attach the exercise weight 100 to one or more wall mount(s) engaging the one or more wall mount prong(s) to one or more of the voids 334-1, 334-2, 334-3, 134-4, 134-5, 134-6, 134-7, and 134-8 found in the exercise weight 100. Depending on the contents found behind the wall, the makeup of the wall, or the arrangement of the workout room, the distance between a first and a second wall mount may vary. Depending on the distance between the first and second wall mount, the prongs found on the first and second wall mount will engage with voids found in the exercise weight 100 corresponding to the distance of the first and second wall mounts. In one example, the user may attach the exercise weight 100 to one or more wall mount(s) and perform pull ups, leg raises, or the like while utilizing any combination of handles.

The distance from one handle to another and the angle of each handle greatly affect the strain the targeted muscle incurs. Thus, the distances between handles and angles of the handles may be altered during or after manufacture to obtain different strains and/or target different muscles and/or muscles in a different way. In some instances, the angle of the handles may be alterable by a user of the exercise weight to change the muscle groups being worked.

Figure 4:
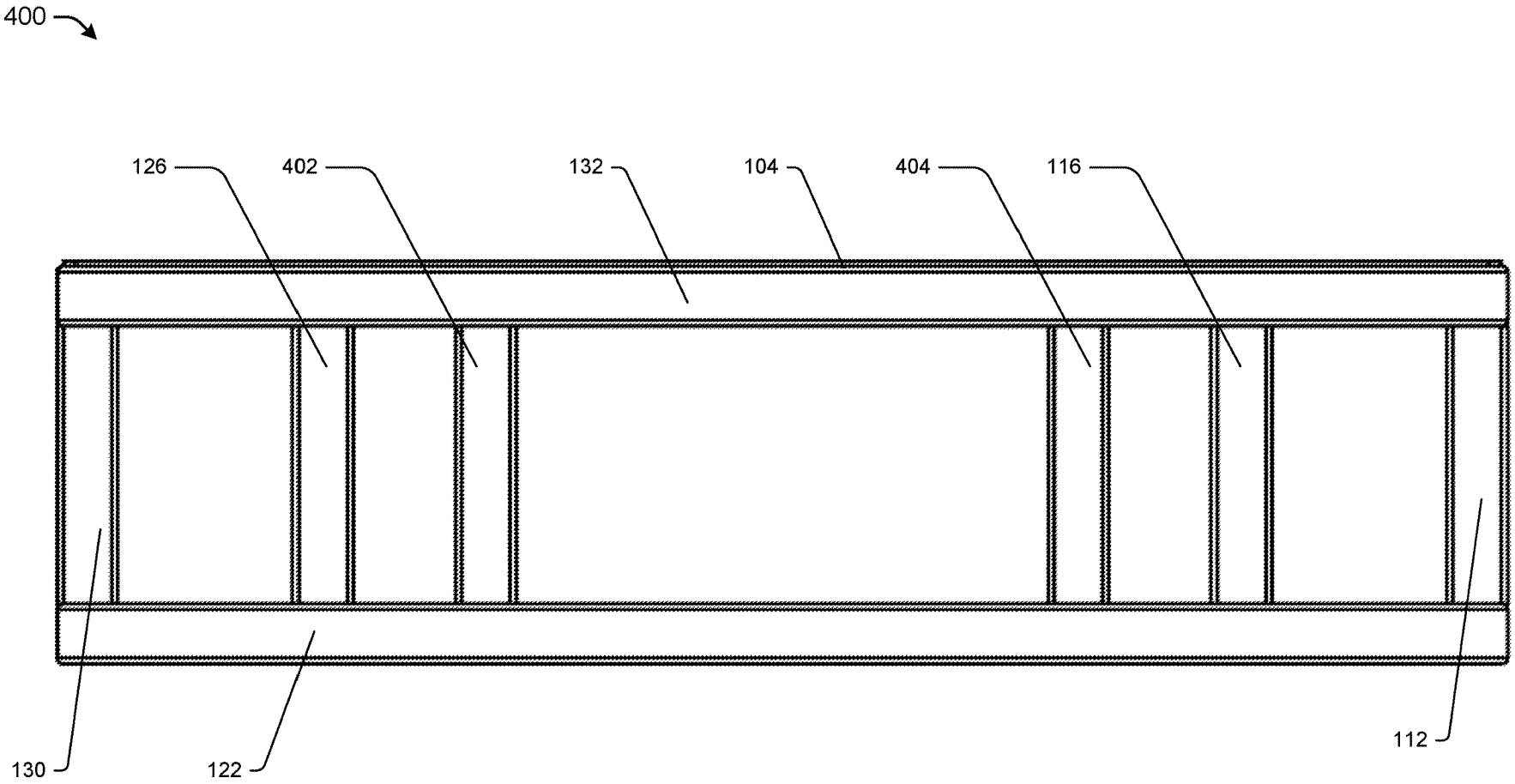
FIG. 4 illustrates a front view of the example exercise weight of FIG. 1.

FIG. 4 illustrates a front view of an example cuboid-shaped exercise weight 100 of an exercise system of FIG. 1. As illustrated, the front side of the exercise weight 100 includes a plate 104, as discussed above, which is disposed on handle 132. The cuboid exercise weight 100 includes handles 126, 402, 404, 116, 112, and 130 which connect perpendicular to the handles 122 and 132. As illustrated, the handles 112, 122, 130 and 132 form a portion of a perimeter of the frame of the exercise weight. Further, the dimensions from a handle to another handle varies depending on the shape, size, and predetermined weight of the exercise weight 100. As illustrated, however, the distance from handle 126 to 116 may range from 1.0-3.0 feet. Further, the distance from handle 402 to handle 404 may range from 0.5-2.8 feet. The distance from handle 126 to 402 may range from 2-12 inches. Of course, while this example describes various dimensions from one handle to another, it is appreciated that the distance from one handle to another may vary greatly depending on the size, shape, and predetermined weight of the exercise weight 100.

In one example, the user may place the exercise weight 100 on the ground with the front side of the exercise weight facing up. The user may perform push-ups gripping handles 126, 402, 404, 116, 112, and 130 or any combination thereof. The user may utilize any combination of grips to perform any combination of workouts. In one example, the user may attach the exercise weight 100 to one or more wall mount(s), grip the handle 122, and perform pull-ups, leg raises, or the like. The user may utilize any combination of grips to perform any combination of workouts.

Figure 5:
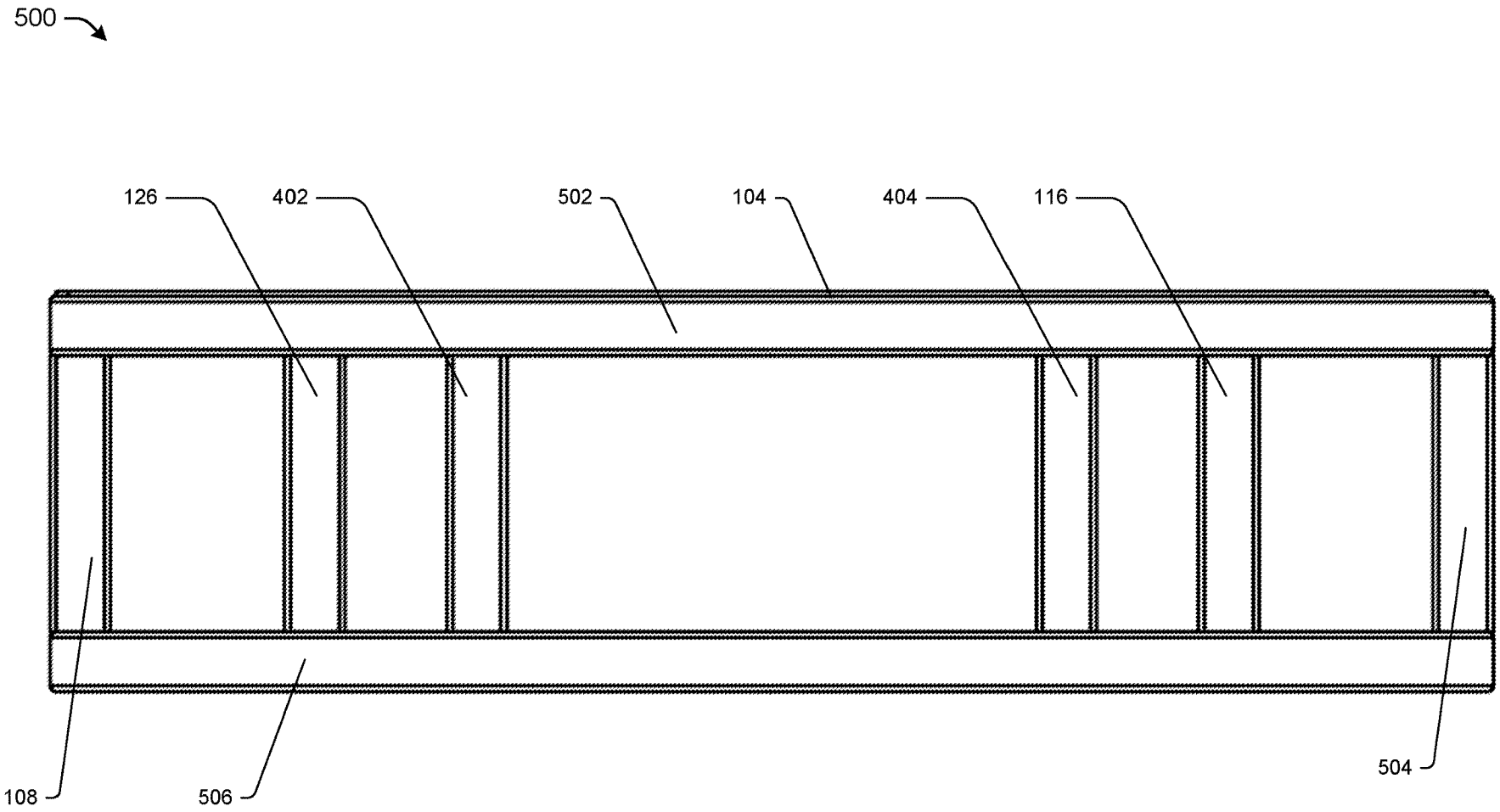
FIG. 5 illustrates a back view of the example exercise weight of FIG. 1.

FIG. 5 illustrates a back view of an example cuboid-shaped exercise weight 100 of an exercise system of FIG. 1. As illustrated, the front side of the exercise weight 100 includes a plate 104, as discussed above, which is disposed on handle 502. The cuboid exercise weight 100 includes handles 108, 126, 402, 404, 116, and 504 which connect perpendicular to the handles 502 and 506. As illustrated, the handles 108, 502, 504, and 506 may form a portion of a perimeter of the frame of the exercise weight 100. Further, the dimensions from a handle to another handle varies depending on the shape, size, and predetermined weight of the exercise weight 100. As illustrated, however, the distance from handle 126 to 116 may range from 1.0-3.0 feet. Further, the distance from handle 402 to handle 404 may range from 0.5-2.8 feet. The distance from handle 126 to 402 may range from 2-12 inches. Of course, while this example describes various dimensions from one handle to another, it is appreciated that the distance from one handle to another may vary greatly depending on the size, shape, and predetermined weight of the exercise weight 100.

In one example, the user may place the exercise weight 100 on the ground with the front side of the exercise weight facing up. The user may perform push-ups gripping handles 108, 126, 402, 404, 116, and 504 or any combination thereof. The user may utilize any combination of grips to perform any combination of workouts. In one example, the user may attach the exercise weight 100 to one or more wall mount(s), grip the handle 506, and perform pull-ups, leg raises, or the like. The user may utilize any combination of grips to perform any combination of workouts.

Figure 6:
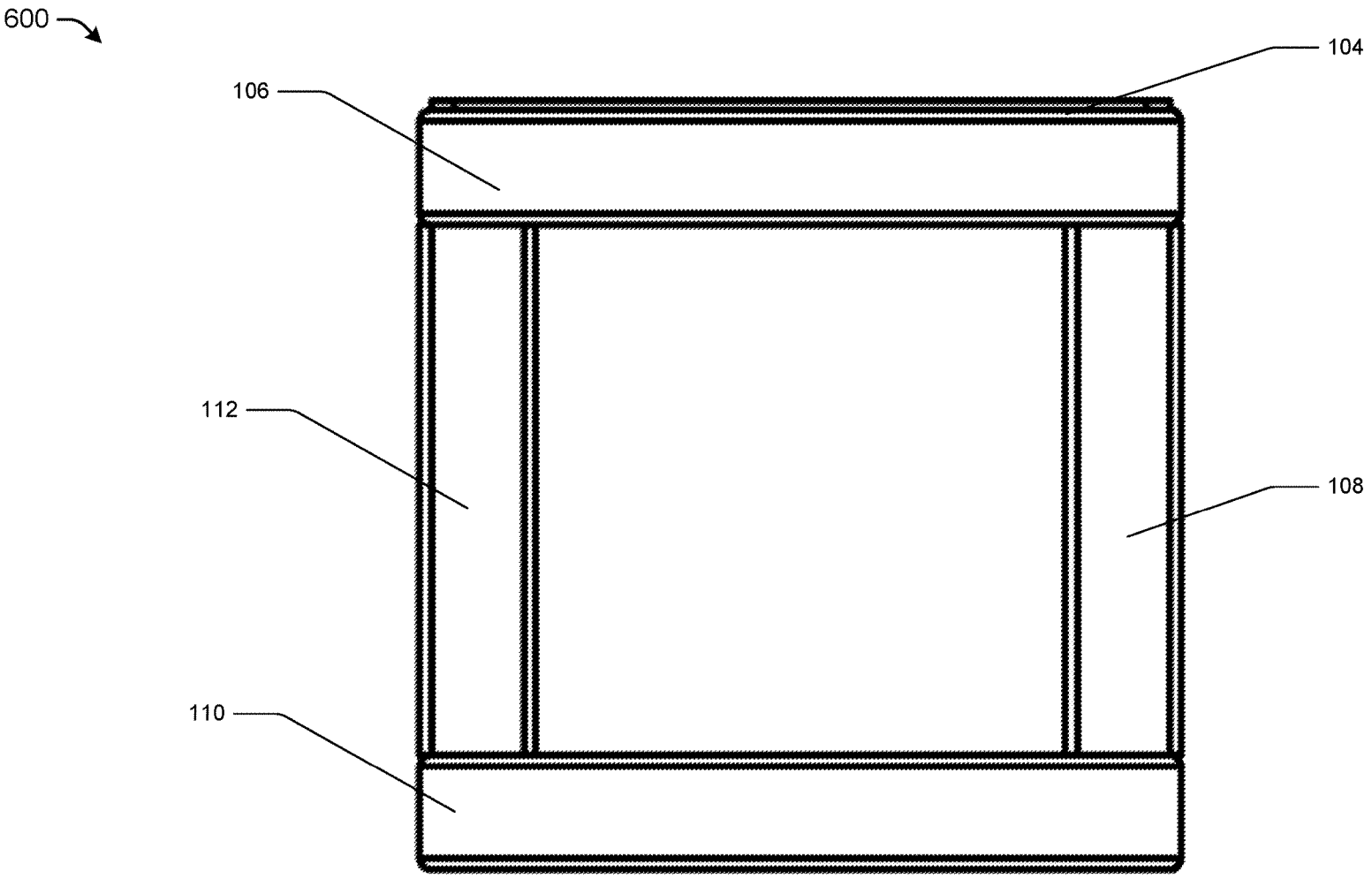
FIG. 6 illustrates a right-side view of the example exercise weight of FIG. 1.

FIG. 6 illustrates a right side view of example cuboid-shaped exercise weight 100 of an exercise system as shown in FIG. 1. As illustrated, the right side of the exercise weight 100 includes four different handles 106, 108, 110, and 112, each of which may form a portion of a perimeter of a frame of the exercise weight 100. The right side also includes the plate 104 disposed on handle 106, as shown in FIG. 1. In one example, the user may attach the exercise weight 100 to one or more wall mount(s). The user may perform pull-ups, leg raises, or a like exercise while gripping, with at least one hand, handle 106 or 110, depending on the orientation of the exercise weight 100. In one example, the user may place the exercise weight 100 on the ground. The user may then perform push-ups while gripping any one of 106, 108, 110, and 112, and/or 104.

Figure 7:
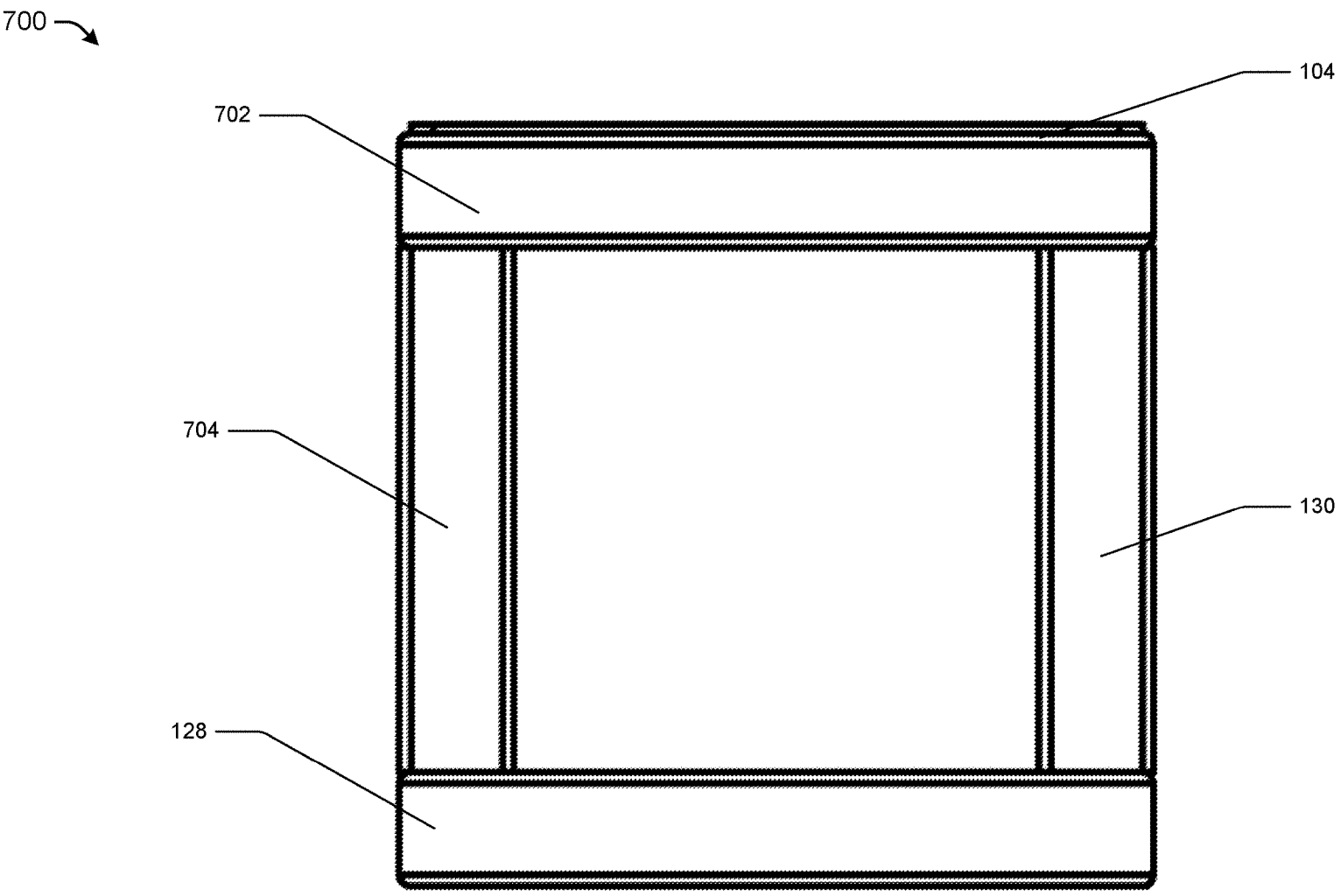
FIG. 7 illustrates a left-side view of the example exercise weight of FIG. 1.

FIG. 7 illustrates a left-side view of example cuboid-shaped exercise weight 100 of an exercise system as shown in FIG. 1. The left side of the exercise weight 100 includes four different handles 702, 130, 128, and 704, each of which may form a portion of a perimeter of a frame of the exercise weight 100. The left side also includes the plate 104 disposed on handle 702. In one example, the user may attach the exercise weight 100 to one or more wall mount(s). The user may perform pull-ups, leg raises, or a like exercise while gripping, with at least one hand, handle 702 or 128, depending on the orientation of the exercise weight 100. In one example, the user may place the exercise weight on the ground. The user may then perform push-ups while gripping any one of 702, 130, 128, and 704, and 104.

Figure 8:
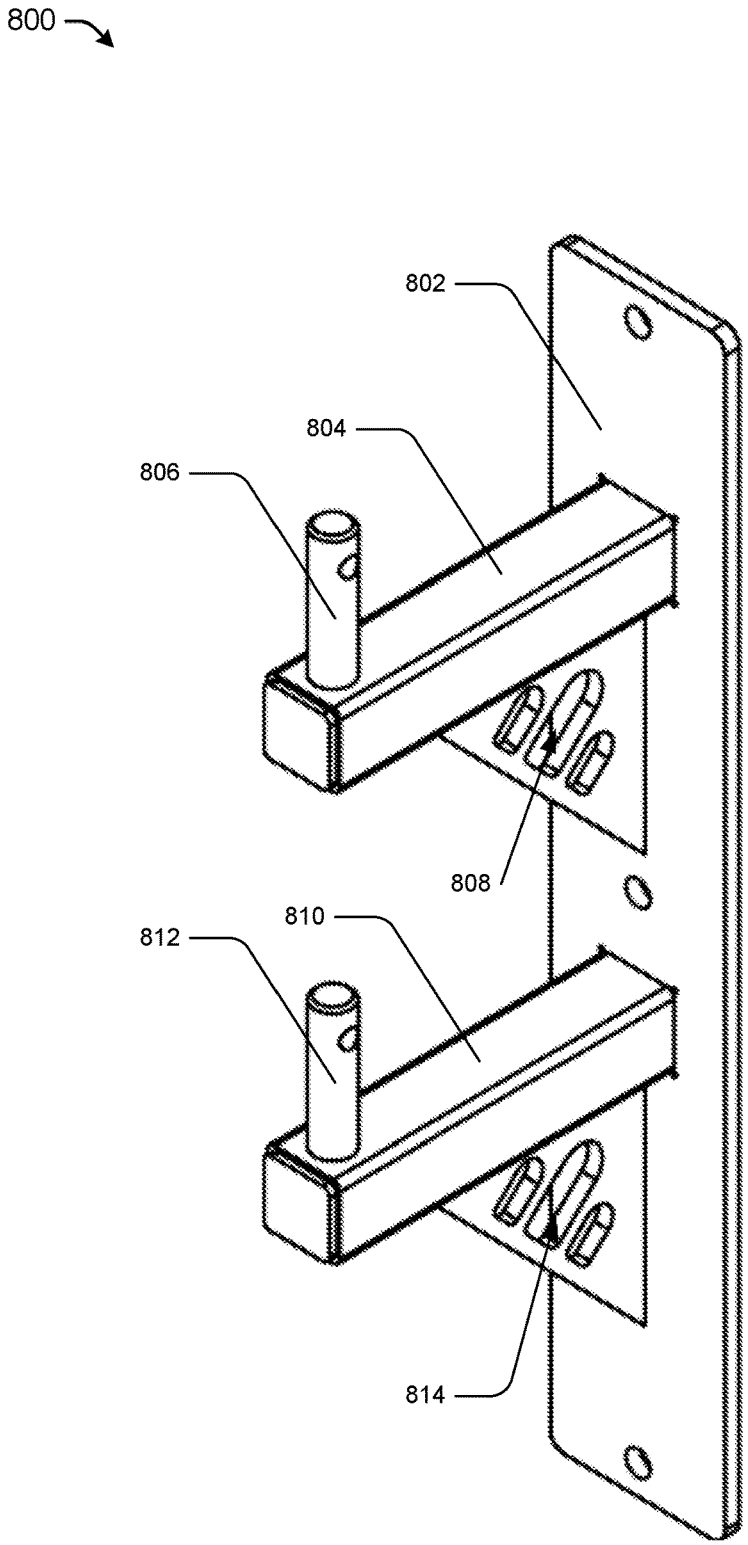
FIG. 8 illustrates a perspective view of an example exercise mount of the exercise system. As introduced above, the example exercise weight of FIG. 1-6 may removably couple to the illustrated exercise mount.

FIG. 8 illustrates a perspective view of an example exercise mount 800 of the exercise system. As introduced above, the example exercise weight of FIG. 1-7 may removably couple to the illustrated exercise mount. As illustrated, one wall mount 800 is shown in FIG. 8, but it can be appreciated that one or more wall mount(s) 800 (e.g., two, spaced apart from another) may be used to engage with the exercise weight 100. Further, the wall mount of FIG. 8 shows a connecting plate 802. The connecting plate 802 may be made of a variety of materials (e.g., all kinds of metal, plastic, composite, etc.). The connecting plate 802 may be attached to any wall, door, or any other suitable surface via any suitable method, such as screws, bolts, or the like. The one or more wall mount(s) 800 may be placed on a wall at varying distances depending on the material makeup of a wall, what is behind a wall, or the workout room location. Further, the connecting plate 802 may be attached to a surface (e.g., wall, door, or the like) by using any fastening tool (e.g., screw, nail, etc.), adhesive, or the like. The dimensions of the connecting plate 802 may range between 2-6 inches in width and 1-3 feet in height.

As shown in FIG. 8, rods 804 and 810 extend from the connecting plate 802. The rods may range from 6-18 inches in length. The rods ensure that the exercise weight 100, when coupled to one or more wall mount(s) 800, is a sufficient distance away from the wall. Further, protruding from the end of the rod opposite to the connecting plate 802 may include prongs 806 and 812. The prongs 806 and 812 may be circular, rectangular, triangular, or any other like shape for engaging with the voids of the exercise weight 100 to couple the exercise weight 100 to the wall mount 800. In one example, a user may want to utilize the exercise system by attaching the exercise weight 100 with the one or more wall mount(s) 800. The user may attach the exercise weight 100 to the one or more wall mount(s) 800 by lifting the exercise weight 100 over the one or more wall mount prongs 806 and 812. The user may align the prongs 806 and 812 with the voids defined in the exercise weight 100 and then slide the prongs 806 and 812 into the voids of the exercise weight 100. While the exercise weight 100 and the one or more wall mount(s) 800 are coupled together, a user may perform exercises such as pull-ups, muscle ups, leg raises, and other like exercises.

The wall mount 800 may also include an attachment plate/region 808 and 814. The attachment plate 808 and 814, as shown, is designed as a triangle. However, any shape may be used (e.g., quarter circle, inverted circle, etc.). In addition, defined in the attachment plate 808 and 814 can include one or more voids. These voids may be designed as any shape. Further, as shown in FIG. 8, there are three voids defined in the attachment plate 808 and 814. However, it can be appreciated that any number of voids of any size may be defined in the attachment plate 808 and 814. A user may utilize the attachment plate 808 and/or 814 by attaching ropes, bands, bars, or other like accessory to perform exercises such as: chest fly, chest press, back pull, or any other like exercise. In one example, a user may attach bands to the attachment plate 808 and 814. The user may then perform bicep curls with the bands while the band is coupled the attachment plates 808 and 814.

In a further example, the prong 812 may be directly under the prong 806, or the two prongs may be offset to any degree and/or in any vertical or horizontal direction. Further, while FIG. 8 illustrates that the wall mount 800 includes two prongs 808 and 812, it is to be appreciated that other embodiments may include a single prong or three or more prongs for attaching to the exercise weight. Further, and as noted above, while not illustrated, in some instances the exercise weight 100 may couple to the mount 800 in other ways, such as via a force fit, magnetically or the like.

Figure 9:
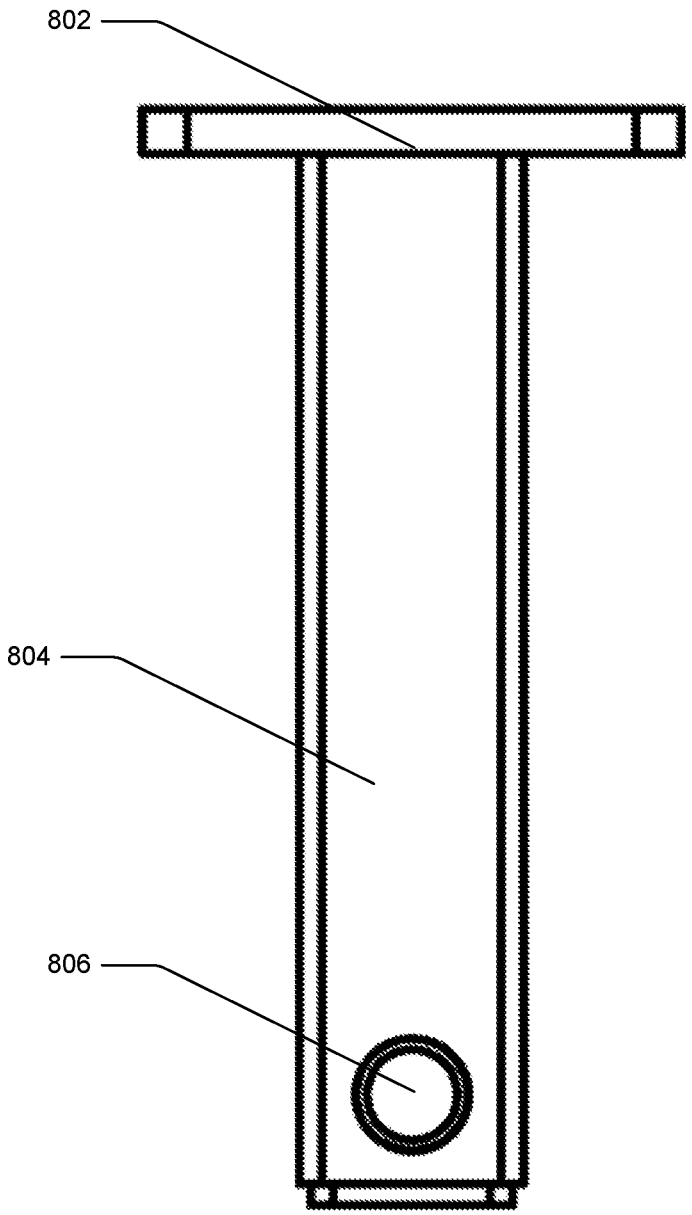
FIG. 9 illustrates a top view of the example exercise mount of FIG. 8.

FIG. 9 illustrates a top view of the example exercise mount of FIG. 8. The connector plate 802, as described above, connects the mount 800 to any wall, door, or like surface. Further, a rod 804 may extend from the connector plate 802. Protruding from the end of the extending rod 804 is a prong 806. The prong 806 is used to couple the exercise weight 100 to the wall mount 800.

Figure 10:
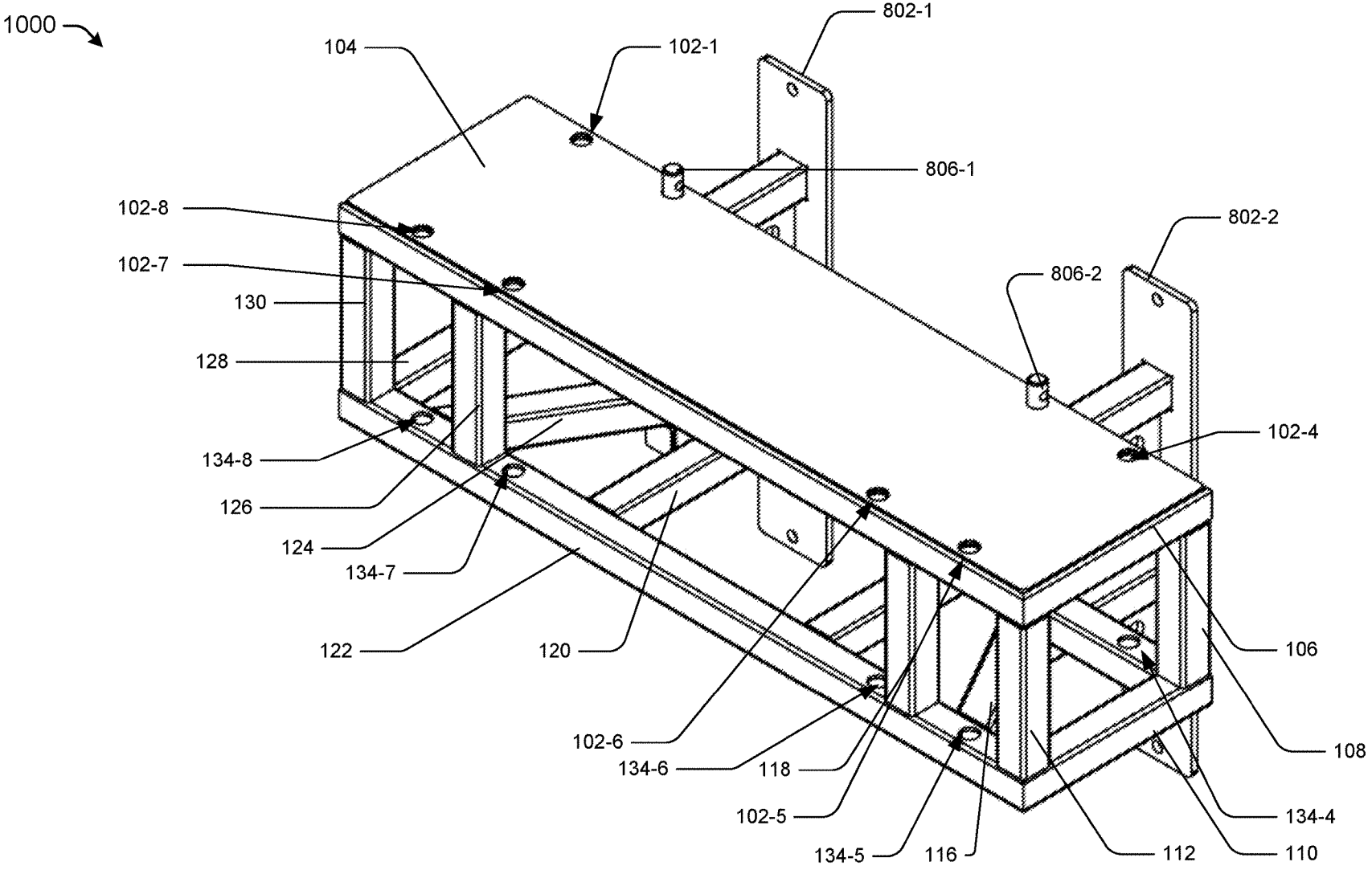
FIG. 10 illustrates a perspective view of the example exercise system when the exercise weight couples to the wall mount.

FIG. 10 illustrates a perspective view of the example exercise system when the exercise weight couples to the wall mount. As illustrated, the exercise weight 100 is coupled to a first and second wall mounts 800(1) and 800(2) (e.g., wall mounts similar to the wall mount 800 in FIG. 8). Further, it is shown that the prongs 806-1 and 806-2 are extending through corresponding voids 102(2) and 102(3) of the exercise weight 100, described above. While not illustrated, it is to be appreciated that the prong 812 may extend through the example void 134-6 described above, while a corresponding prong of the second wall mount 800(2) may extend through the example void 134-7 described above. The user may decide the height of the exercise system upon installation. Depending on the height of the room's ceiling, the height of the user, and/or the make-up of the wall, the user may decide to place the wall mount(s) 800 and an appropriate height to still allow for pull-ups, leg raises, or the like. Further, the user may decide the distance between the wall mounts 800(1) and 800(2). For instance, in the illustrated example of FIG. 10, the user has installed the wall mounts 800(1) and 800(2) at a distance relative to one another such that the prongs alight the voids 102(2) and 102(3) (as well as the corresponding voids directly underneath). In other instances, however, the user may space the wall mounts 800(1) and 800(2) such that the prongs align with the voids 102(1) and 102(4) (as well as the corresponding voids directly underneath). Further, while the illustrated exercise weight 100 includes voids to accommodate these two distances, it is to be appreciated that in other instances the weight 100 may include one or more additional sets of voids to accommodate still other distances. Further, while this example describes two independent wall mounts 800(1) and 800(2), in some instances the exercise system may utilize a wall-mount system where the functionality of 800(1) and 800(2) are a single component. For instance, a plate that resides against when the wall (when the mount is attached to the wall) may couple to the functionality of the mount 800(1) and 800(2) such that the user need only install the single mount system without needing to measure the proper distance between the mounts in order for the prongs of the mounts to align with the voids of the exercise weight 100.

Although several embodiments have been described in language specific to structural features and/or methodological acts, it is to be understood that the embodiments are not necessarily limited to the specific features or acts described. Rather, the specific features and acts are disclosed as illustrative forms of implementing the claimed subject matter.

What is claimed is:

1. An exercise system comprising:

an exercise mount configured to attach to a vertical surface and comprising one or more prongs that extend in a vertical direction;

an exercise weight comprising a cuboid-shaped frame and one or more handles coupled to and residing at least partly within the cuboid-shaped frame, wherein the exercise weight includes a plurality of voids for receiving the one or more prongs of the exercise mount, and wherein a side of the exercise weight comprises a plate that covers at least a portion of the side, wherein the one or more handles include a first void of the plurality of voids, wherein the plate includes a second void of the plurality of voids, wherein the first void is wherein the first void is positioned and arranged to be complementary with the second void; and wherein the exercise weight is configured to detachably couple to the exercise mount by inserting the one or more prongs into the plurality of voids.

2. The exercise system of claim 1, wherein the plate comprises one or more protrusions extending from the plate, wherein the plate includes a first side and a second side, wherein the first side faces an interior portion of the cuboid-shaped frame, wherein the second side faces a direction opposite the first side, and wherein the one or more protrusions are on the second side.

3. The exercise system of claim 1, wherein the one or more handles comprise a first handle and a second handle, the first handle and the second handle being configured to extend a length of the cuboid-shaped frame, and wherein the one or more handles further comprise a third handle that is configured to extend between the first handle and the second handle at a non-zero angle.

4. The exercise system of claim 1, wherein the exercise mount comprises one or more attachment plates located at a position below the one or more prongs.

5. The exercise system of claim 1, wherein the one or more prongs comprise a first prong and a second prong arranged on the exercise mount on a vertical axis.

6. An apparatus comprising: a mount configured to attach to a vertical surface and comprising one or more prongs that extend in a vertical direction; and a weight comprising a cuboid-shaped frame and one or more handles coupled to and residing at least partly within the cuboid-shaped frame, wherein the weight includes a plurality of voids for receiving the one or more prongs of the mount, and wherein a side of the weight comprises a plate that covers at least a portion of the side, wherein the one or more handles include a first void of the plurality of voids, wherein the plate includes a second void of the plurality of voids, wherein the first void is positioned and arranged to be complementary with the second void.

7. The apparatus of claim 6, wherein the weight is configured to detachably couple to the mount by inserting the one or more prongs into the plurality of voids.

8. The apparatus of claim 6, wherein the plate comprises one or more protrusions extending from the plate, wherein the plate includes a first side and a second side, wherein the first side faces an interior portion of the cuboid-shaped frame, wherein the second side faces a direction opposite the first side, and wherein the one or more protrusions are on the second side.

9. The apparatus of claim 6, wherein the one or more handles comprise a first handle and a second handle, the first handle and the second handle being configured to extend a length of the cuboid-shaped frame, and wherein the one or more handles further comprise a third handle that is configured to extend between the first handle and the second handle at a non-zero angle.

10. The apparatus of claim 6, wherein the mount comprises one or more attachment plates located at a position below the one or more prongs.

11. The apparatus of claim 6, wherein the one or more prongs comprise a first prong and a second prong arranged on the mount in a vertical axis.

12. The apparatus of claim 6, wherein the plate is made of metal.

13. The apparatus of claim 6, wherein the one or more handles are a square cross-sectional shape.

14. An exercise system comprising: a mount configured to attach to a vertical surface and comprising a first prong and a second prong that extend in a vertical direction; and a weight comprising a cuboid-shaped frame and one or more handles coupled to and residing at least partly within the cuboid-shaped frame, wherein the weight includes a plurality of voids for receiving the first prong and the second prong of the mount, and wherein a side of the weight comprises a plate that covers at least a portion of the side, wherein the one or more handles include a first void of the plurality of voids, wherein the plate includes a second void of the plurality of voids, wherein the first void is positioned and arranged to be complementary with the second void.

15. The exercise system of claim 14, wherein the weight is configured to detachably couple to the mount by inserting the one or more prongs into the plurality of voids.

16. The exercise system of claim 14, wherein the plate comprises one or more protrusions extending from the plate.

17. The exercise system of claim 14, wherein the one or more handles comprise a first handle and a second handle, the first handle and the second handle being configured to extend a length of the cuboid-shaped frame, and wherein the one or more handles further comprise a third handle that is configured to extend between the first handle and the second handle at a non-zero angle.

18. The exercise system of claim 14, wherein the mount comprises one or more attachment plates located at a position below the one or more prongs.

19. The exercise system of claim 14, wherein the first prong and the second prong are arranged on the mount in a vertical axis.

20. The exercise system of claim 14, wherein the one or more handles are a square cross-sectional shape.

* * * * *